US007127389B2

(12) United States Patent
Chazan et al.

(10) Patent No.: US 7,127,389 B2
(45) Date of Patent: Oct. 24, 2006

(54) METHOD FOR ENCODING AND DECODING SPECTRAL PHASE DATA FOR SPEECH SIGNALS

(75) Inventors: Dan Chazan, Haifa (IL); Zvi Kons, Nesher (IL)

(73) Assignee: International Business Machines Corporation, Armonk, NY (US)

( * ) Notice: Subject to any disclaimer, the term of this patent is extended or adjusted under 35 U.S.C. 154(b) by 930 days.

(21) Appl. No.: 10/243,580

(22) Filed: Sep. 13, 2002

(65) Prior Publication Data

US 2004/0054526 A1 Mar. 18, 2004

(51) Int. Cl.
*G10L 11/04* (2006.01)

(52) U.S. Cl. ..... 704/205; 704/207

(58) Field of Classification Search ..... 704/205, 704/207

See application file for complete search history.

(56) References Cited

U.S. PATENT DOCUMENTS

| | | | | | |
|---|---|---|---|---|---|
| 4,885,790 | A * | 12/1989 | McAulay et al. | ..... | 704/265 |
| 5,195,166 | A * | 3/1993 | Hardwick et al. | ..... | 704/200 |
| 5,686,683 | A * | 11/1997 | Freed | ..... | 84/625 |
| 5,832,437 | A * | 11/1998 | Nishiguchi et al. | ..... | 704/268 |
| 5,884,253 | A * | 3/1999 | Kleijn | ..... | 704/223 |
| 5,903,866 | A * | 5/1999 | Shoham | ..... | 704/265 |
| 6,014,617 | A * | 1/2000 | Kawahara | ..... | 704/207 |
| 6,475,245 | B1 * | 11/2002 | Gersho et al. | ..... | 704/208 |
| 6,996,523 | B1 * | 2/2006 | Bhaskar et al. | ..... | 704/222 |

* cited by examiner

*Primary Examiner*—Michael N. Opsasnick
(74) *Attorney, Agent, or Firm*—Stephen C. Kaufman

(57) ABSTRACT

A speech decoder and a segment aligner are provided in the present invention. The speech decoder may include a spectrum reconstructor operative to reconstruct the spectrum of a speech segment from the amplitude envelope of the spectrum of said speech segment and pitch information, a phase combiner operative to reconstruct the complex spectrum of the speech segment from the reconstructed spectrum, phase information describing the speech segment, and pitch information describing the speech segment. The speech decoder may further include a delay operative to store a complex spectrum of a previous speech segment; and a segment aligner operative to determine the relative offset between the complex spectrum of the speech segment and the complex spectrum of the previous speech segment, align the position of the first pitch excitation of the current speech segment to the last pitch excitation of the previous speech segment; and to apply a time shift and a complex Hilbert filter to said complex spectra, wherein the segment aligner is operative to cross-correlate the complex spectra as $$C(\tau) = \sum_{n=0}^{N} F_n \overline{G}_m e^{-2\pi i n \tau},\ m = \left\lfloor n \frac{p_G}{p_F} + 0.5 \right\rfloor,$$

where $F_n$ and $G_m$ are the computed complex magnitude of the pitch harmonics n and m of the current and previous spectra respectively, and $p_F$ and $p_G$ are their corresponding pitch periods.

10 Claims, 6 Drawing Sheets

METHOD FOR ENCODING AND DECODING SPECTRAL PHASE DATA FOR SPEECH SIGNALS

FIELD OF THE INVENTION

The present invention relates to speech processing in general, and more particularly to phase alignment thereof.

BACKGROUND OF THE INVENTION

Many speech encoding and decoding systems represent voice segments by their spectral envelope. In some systems the segments are represented only by the absolute magnitude of the spectrum, and the phase is generated synthetically for the reconstruction. Such systems suffer from poor initial phase alignment which results in poor compression of phase data and poor combination with the synthetic phase. They also do not allow real and synthetic phase data to be combined in the same frame, and their final alignment suffers from poor segment connection.

SUMMARY OF THE INVENTION

The present invention discloses a method for improving the sound quality of compressed speech by encoding the complex phase of the spectral envelope and using the encoded phase information during decoding to reproduce a speech segment having a smooth transition from the previous segment. The phase encoder of the present invention can work independently or in combination with amplitude encoding. During decoding, the decoder combines decoded phase information with the spectrum created from decoded amplitude information. The decoder then aligns the complex spectrum of the current segment with the spectrum of the previous segment to produce the desired pitch cycles. The present invention provides improved speech quality by using alignment both in the encoder and the decoder, by improving both alignment methods, and by allowing combination of real and synthetic phase data.

In one aspect of the present invention a speech encoder is provided including a pitch detector operative to determine the pitch frequency of a speech segment, a spectral estimator operative to estimate the complex spectrum of the speech segment at the pitch frequency, an envelope encoder operative to calculate the amplitude of the complex spectrum, a phase aligner operative to remove a phase term which is linear in frequency from each of a plurality of complex values of the complex spectrum, and calculate a series of division products of each of the plurality of complex values by the square root of the absolute value of each of the complex values, where the series has a minimum total variation, thereby resulting in an aligned phase $\theta_k$, and a phase encoder operative to encode the phase information.

In another aspect of the present invention the spectral estimator is operative to estimate a signal of the complex spectrum at a time t as $$x(t) \cong \sum_k A_k e^{i\varphi_k} e^{2\pi i f_k t}$$

where $A_k$ is the amplitude of the speech segment and $\phi_k$ is the phase of each pitch harmonic $f_k$ of the speech segment.

In another aspect of the present invention the spectral estimator is a Fourier transformator operative to calculate Fourier coefficients at multiples of the pitch frequency.

In another aspect of the present invention the phase aligner is operative to calculate the aligned phase $\theta_k$ of the complex spectrum after a time offset $\tau$ as $\theta_k=\phi_k-2\pi\tau f_k$.

In another aspect of the present invention the phase aligner is operative to calculate the linear phase term having a coefficient $\tau$ being $$\tau = \arg\min_\tau \sum_{k=0}^{N-1} \left| \sqrt{A_{k+1}}\, e^{i\varphi_{k+1}-2\pi\tau(f_{k+1}-f_k)} - \sqrt{A_k}\, e^{i\varphi_k} \right|^2$$

where the coefficient $\tau$ is operative to minimize the total variation of the complex spectrum divided by the square root of its absolute value.

In another aspect of the present invention a phase aligner is provided including means for removing a phase term which is linear in frequency from each of a plurality of complex values of a complex spectrum of a speech segment, and means for calculating a series of division products of each of the plurality of complex values by the square root of the absolute value of each of the complex values, where the series has a minimum total variation, thereby resulting in an aligned phase $\theta_k$.

In another aspect of the present invention the means for calculating is operative to calculate the aligned phase $\theta_k$ of the complex spectrum after a time offset $\tau$ as $\theta_k=\phi_k-2\pi\tau f_k$.

In another aspect of the present invention the means for removing is operative to calculate the linear phase term having a coefficient $\tau$ being $$\tau = \arg\min_\tau \sum_{k=0}^{N-1} \left| \sqrt{A_{k+1}}\, e^{i\varphi_{k+1}-2\pi\tau(f_{k+1}-f_k)} - \sqrt{A_k}\, e^{i\varphi_k} \right|^2$$

where the coefficient $\tau$ is operative to minimize the total variation of the complex spectrum divided by the square root of its absolute value.

In another aspect of the present invention a speech decoder is provided including a spectrum reconstructor operative to reconstruct the spectrum of a speech segment from the amplitude envelope of the spectrum of the speech segment and pitch information, a phase combiner operative to reconstruct the complex spectrum of the speech segment from the reconstructed spectrum, phase information describing the speech segment, and pitch information describing the speech segment, a delay operative to store a complex spectrum of a previous speech segment, and a segment aligner operative to determine the relative offset between the complex spectrum of the speech segment and the complex spectrum of the previous speech segment, align the position of the first pitch excitation of the current speech segment to the last pitch excitation of the previous speech segment, and apply a time shift and a complex Hilbert filter to the complex spectra.

In another aspect of the present invention the speech decoder further includes an inverse Fourier transformator operative to convert the aligned complex spectra into time-domain signals and concatenate the time-domain signals with at least one other speech segment.

In another aspect of the present invention the pitch information describes the pitch of the speech segment prior to encoding.

In another aspect of the present invention the segment aligner is operative to cross-correlate the complex spectra as $$C(\tau)=\sum_{n=0}^{N} F_n \overline{G}_m e^{-2\pi i n\tau},\ m=\left\lfloor n\frac{p_G}{p_F}+0.5\right\rfloor.$$

where $F_n$ and $G_m$ are the computed complex magnitude of the pitch harmonics n and m of the current and previous spectra respectively, and $p_F$ and $p_G$ are their corresponding pitch periods.

In another aspect of the present invention the segment aligner is operative to cross-correlate on the Hilbert transform of the spectra and sum only the positive frequencies (n, m≧0) of the spectra.

In another aspect of the present invention the segment aligner is operative to apply a time shift $\tau_m=\arg\max\{|C(\tau)|\}$ and a constant phase shift $\theta_0=-\arg(C(\tau_m))$ to the current spectrum.

In another aspect of the present invention the segment aligner is operative to determine the offset of the current complex spectrum as $\delta=n_p p_G-\Delta T$ where there are $$n_p=\left\lfloor\frac{\Delta T}{p_G}+0.5\right\rfloor$$

pitch cycles in the previous complex spectrum, and where ΔT is the time offset between the complex spectra.

In another aspect of the present invention the segment aligner is operative to apply the time shift and the complex Hilbert filter by multiplying $F_n(t)$ with $e^{i\Delta\theta_n}$, where $\Delta\theta_n$ is given by $$\Delta\theta_n=\begin{cases}\theta_0+n\theta_1 & n\geq 0\\ -\theta_0+n\theta_1 & n<0\end{cases}\text{ with }\theta_1=-2\pi\left(\tau_m+\frac{\delta}{p_F}\right).$$

In another aspect of the present invention a segment aligner is provided including means for determining the relative offset between a complex spectrum of a speech segment and a complex spectrum of a previous speech segment, means for aligning the position of the first pitch excitation of the current speech segment to the last pitch excitation of the previous speech segment, and means for applying a time shift and a complex Hilbert filter to the complex spectra.

In another aspect of the present invention the means for determining is operative to cross-correlate the complex spectra as $$C(\tau)=\sum_{n=0}^{N} F_n \overline{G}_m e^{-2\pi i n\tau},$$

$$m=\left\lfloor n\frac{p_G}{p_F}+0.5\right\rfloor,$$

where $F_n$ and $G_m$ are the computed complex magnitude of the pitch harmonics n and m of the current and previous spectra respectively, and $p_F$ and $p_G$ are their corresponding pitch periods.

In another aspect of the present invention the means for determining is operative to cross-correlate on the Hilbert transform of the spectra and sum only the positive frequencies (n, m≧0) of the spectra.

In another aspect of the present invention the means for aligning is operative to apply a time shift $\tau_m=\arg\max\{|C(\tau)|\}$ and a constant phase shift $\theta_0=-\arg(C(\tau_m))$ to the current spectrum.

In another aspect of the present invention the means for determining is operative to determine the offset of the current complex spectrum as $\delta=n_p p_G-\Delta T$ where there are $$n_p=\left\lfloor\frac{\Delta T}{p_G}+0.5\right\rfloor$$

pitch cycles in the previous complex spectrum, and where ΔT is the time offset between the complex spectra.

In another aspect of the present invention the means for aligning is operative to apply the time shift and the complex Hilbert filter by multiplying $F_n(t)$ with $e^{i\Delta\theta_n}$, where $\Delta\theta_n$ is given by $$\Delta\theta_n=\begin{cases}\theta_0+n\theta_1 & n\geq 0\\ -\theta_0+n\theta_1 & n<0\end{cases}\text{ with }\theta_1=-2\pi\left(\tau_m+\frac{\delta}{p_F}\right).$$

In another aspect of the present invention a method is provided for speech encoding including determining the pitch frequency of a speech segment, estimating the complex spectrum of the speech segment at the pitch frequency, calculating the amplitude of the complex spectrum, removing a phase term which is linear in frequency from each of a plurality of complex values of the complex spectrum, calculating a series of division products of each of the plurality of complex values by the square root of the absolute value of each of the complex values, where the series has a minimum total variation, thereby resulting in an aligned phase $\theta_k$, and encoding the phase information.

In another aspect of the present invention the estimating step includes estimating a signal of the complex spectrum at a time t as $$x(t)\cong\sum_k A_k e^{i\varphi_k} e^{2\pi i f_k t}$$

where $A_k$ is the amplitude of the speech segment and $\phi_k$ is the phase of each pitch harmonic $f_k$ of the speech segment.

In another aspect of the present invention the estimating step includes calculating Fourier coefficients at multiples of the pitch frequency.

In another aspect of the present invention the calculating a series step includes calculating the aligned phase $\theta_k$ of the complex spectrum after a time offset τ as $\theta_k=\phi_k-2\pi\tau f_k$.

In another aspect of the present invention the removing step includes calculating the linear phase term having a coefficientτ being $$\tau = \arg\min_{\tau} \sum_{k=0}^{N-1} |\sqrt{A_{k+1}}\, e^{i\varphi_{k+1}-2\pi\tau(f_{k+1}-f_k)} - \sqrt{A_k}\, e^{i\varphi_k}|^2$$

where the coefficient$\tau$ is operative to minimize the total variation of the complex spectrum divided by the square root of its absolute value.

In another aspect of the present invention a method is provided for phase aligning including removing a phase term which is linear in frequency from each of a plurality of complex values of a complex spectrum of a speech segment, and calculating a series of division products of each of the plurality of complex values by the square root of the absolute value of each of the complex values, where the series has a minimum total variation, thereby resulting in an aligned phase $\theta_k$.

In another aspect of the present invention the calculating step includes calculating the aligned phase $\theta_k$ of the complex spectrum after a time offset $\tau$ as $\theta_k=\phi_k-2\pi\tau f_k$.

In another aspect of the present invention the removing step includes calculating the linear phase term having a coefficient $\tau$ being $$\tau = \arg\min_{\tau} \sum_{k=0}^{N-1} |\sqrt{A_{k+1}}\, e^{i\varphi_{k+1}-2\pi\tau(f_{k+1}-f_k)} - \sqrt{A_k}\, e^{i\varphi_k}|^2$$

where the coefficient $\tau$ is operative to minimize the total variation of the complex spectrum divided by the square root of its absolute value.

In another aspect of the present invention a method is provided for speech decoding including reconstructing the spectrum of a speech segment from the amplitude envelope of the spectrum of the speech segment and pitch information, reconstructing the complex spectrum of the speech segment from the reconstructed spectrum, phase information describing the speech segment, and pitch information describing the speech segment, storing a complex spectrum of a previous speech segment, determining the relative offset between the complex spectrum of the speech segment and the complex spectrum of the previous speech segment, aligning the position of the first pitch excitation of the current speech segment to the last pitch excitation of the previous speech segment, and applying a time shift and a complex Hilbert filter to the complex spectra.

In another aspect of the present invention the method further includes converting the aligned complex spectra into time-domain signals, and concatenating the time-domain signals with at least one other speech segment.

In another aspect of the present invention the reconstructing the spectrum step includes reconstructing with the pitch information that describes the pitch of the speech segment prior to encoding.

In another aspect of the present invention the determining step includes cross-correlating the complex spectra as $$C(\tau) = \sum_{n=0}^{N} F_n \overline{G}_m e^{-2\pi i n\tau},\ m = \left\lfloor n\frac{p_G}{p_F} + 0.5 \right\rfloor.$$

where $F_n$ and $G_m$ are the computed complex magnitude of the pitch harmonics n and m of the current and previous spectra respectively, and $p_F$ and $p_G$ are their corresponding pitch periods.

In another aspect of the present invention the determining step includes cross-correlating on the Hilbert transform of the spectra and sum only the positive frequencies (n, m≧0) of the spectra.

In another aspect of the present invention the aligning step includes applying a time shift $\tau_m$=arg max{|C($\tau$)|} and a constant phase shift $\theta_0$=−arg(C($\tau_m$)) to the current spectrum.

In another aspect of the present invention the determining step includes determining the offset of the current complex spectrum as $\delta=n_p p_G-\Delta T$ where there are $$n_p = \left\lfloor \frac{\Delta T}{p_G} + 0.5 \right\rfloor$$

pitch cycles in the previous complex spectrum, and where $\Delta T$ is the time offset between the complex spectra.

In another aspect of the present invention the aligning step includes applying the time shift and the complex Hilbert filter by multiplying $F_n(t)$ with $e^{i\Delta\theta_n}$, where $\Delta\theta_n$ is given by $$\Delta\theta_n = \begin{cases} \theta_0 + n\theta_1 & n \geq 0 \\ -\theta_0 + n\theta_1 & n < 0 \end{cases} \text{ with } \theta_1 = -2\pi\left(\tau_m + \frac{\delta}{p_F}\right).$$

In another aspect of the present invention a method is provided for segment aligning including determining the relative offset between a complex spectrum of a speech segment and a complex spectrum of a previous speech segment, aligning the position of the first pitch excitation of the current speech segment to the last pitch excitation of the previous speech segment, and applying a time shift and a complex Hilbert filter to the complex spectra.

In another aspect of the present invention the determining step includes cross-correlating the complex spectra as $$C(\tau) = \sum_{n=0}^{N} F_n \overline{G}_m e^{-2\pi i n\tau},\ m = \left\lfloor n\frac{p_G}{p_F} + 0.5 \right\rfloor,$$

where $F_n$ and $G_m$ are the computed complex magnitude of the pitch harmonics n and m of the current and previous spectra respectively, and $p_F$ and $p_G$ are their corresponding pitch periods.

In another aspect of the present invention the determining step includes cross-correlating on the Hilbert transform of the spectra and sum only the positive frequencies (n, m≧0) of the spectra.

In another aspect of the present invention the aligning step includes applying a time shift $\tau_m$=arg max{|C($\tau$)|} and a constant phase shift $\theta_0$=−arg(C($\tau_m$)) to the current spectrum.

In another aspect of the present invention the determining step includes determining the offset of the current complex spectrum as $\delta=n_p p_G-\Delta T$ where there are $$n_p = \left\lfloor \frac{\Delta T}{p_G} + 0.5 \right\rfloor$$

pitch cycles in the previous complex spectrum, and where $\Delta T$ is the time offset between the complex spectra.

In another aspect of the present invention the aligning step includes applying the time shift and the complex Hilbert filter by multiplying $F_n(t)$ with $e^{i\Delta\theta_n}$, where $\Delta\theta_n$ is given by $$\Delta\theta_n = \begin{cases} \theta_0 + n\theta_1 & n \geq 0 \\ -\theta_0 + n\theta_1 & n < 0 \end{cases} \text{ with } \theta_1 = -2\pi\left(\tau_m + \frac{\delta}{p_F}\right).$$

In another aspect of the present invention a computer program is provided embodied on a computer-readable medium, the computer program including a first code segment operative to determine the pitch frequency of a speech segment, a second code segment operative to estimate the complex spectrum of the speech segment at the pitch frequency, a third code segment operative to calculate the amplitude of the complex spectrum, a fourth code segment operative to remove a phase term which is linear in frequency from each of a plurality of complex values of the complex spectrum, and calculate a series of division products of each of the plurality of complex values by the square root of the absolute value of each of the complex values, where the series has a minimum total variation, thereby resulting in an aligned phase $\theta_k$, and a fifth code segment operative to encode the phase information.

In another aspect of the present invention a computer program is provided embodied on a computer-readable medium, the computer program including a first code segment operative to reconstruct the spectrum of a speech segment from the amplitude envelope of the spectrum of the speech segment and pitch information, a second code segment operative to reconstruct the complex spectrum of the speech segment from the reconstructed spectrum, phase information describing the speech segment, and pitch information describing the speech segment, a third code segment operative to store a complex spectrum of a previous speech segment, and a fourth code segment operative to determine the relative offset between the complex spectrum of the speech segment and the complex spectrum of the previous speech segment, align the position of the first pitch excitation of the current speech segment to the last pitch excitation of the previous speech segment, and apply a time shift and a complex Hilbert filter to the complex spectra.

BRIEF DESCRIPTION OF THE DRAWINGS

The present invention will be understood and appreciated more fully from the following detailed description taken in conjunction with the appended drawings in which.

DETAILED DESCRIPTION OF PREFERRED EMBODIMENTS

Figure 1:
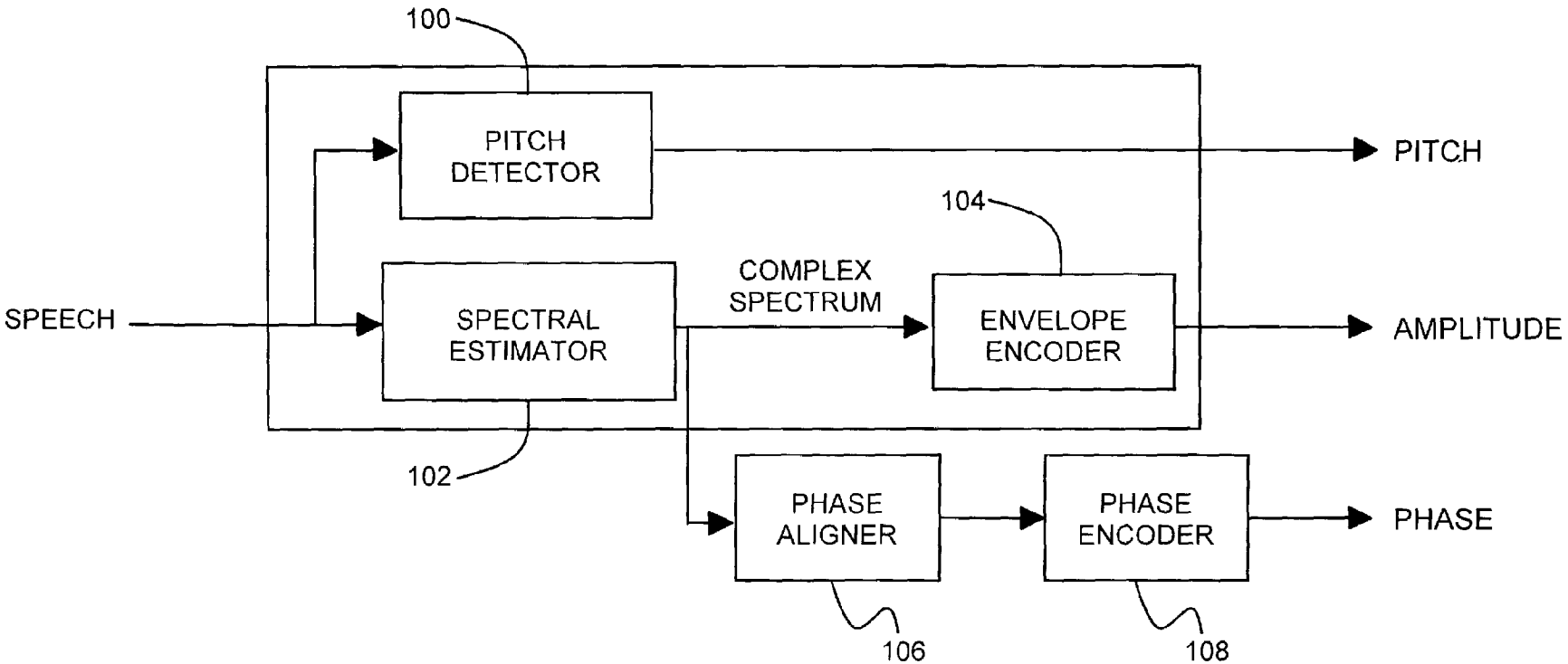
FIG. 1 is a simplified block diagram illustration of a speech encoder, constructed and operative in accordance with a preferred embodiment of the present invention.

Reference is now made to FIG. 1, which is a simplified block diagram illustration of a speech encoder, constructed and operative in accordance with a preferred embodiment of the present invention. In the speech encoder of FIG. 1, a speech segment is input into a pitch detector 100 which determines the pitch of the speech segment. The speech segment is also input into a spectral estimator 102, such as a Fourier transformator, which estimates the complex spectrum of the speech segment. An envelope encoder 104 calculates the amplitude of the complex spectrum. A phase aligner 106 extracts the phase information from the complex spectrum. The phase information is then encoded at a phase encoder 108.

Figure 2:
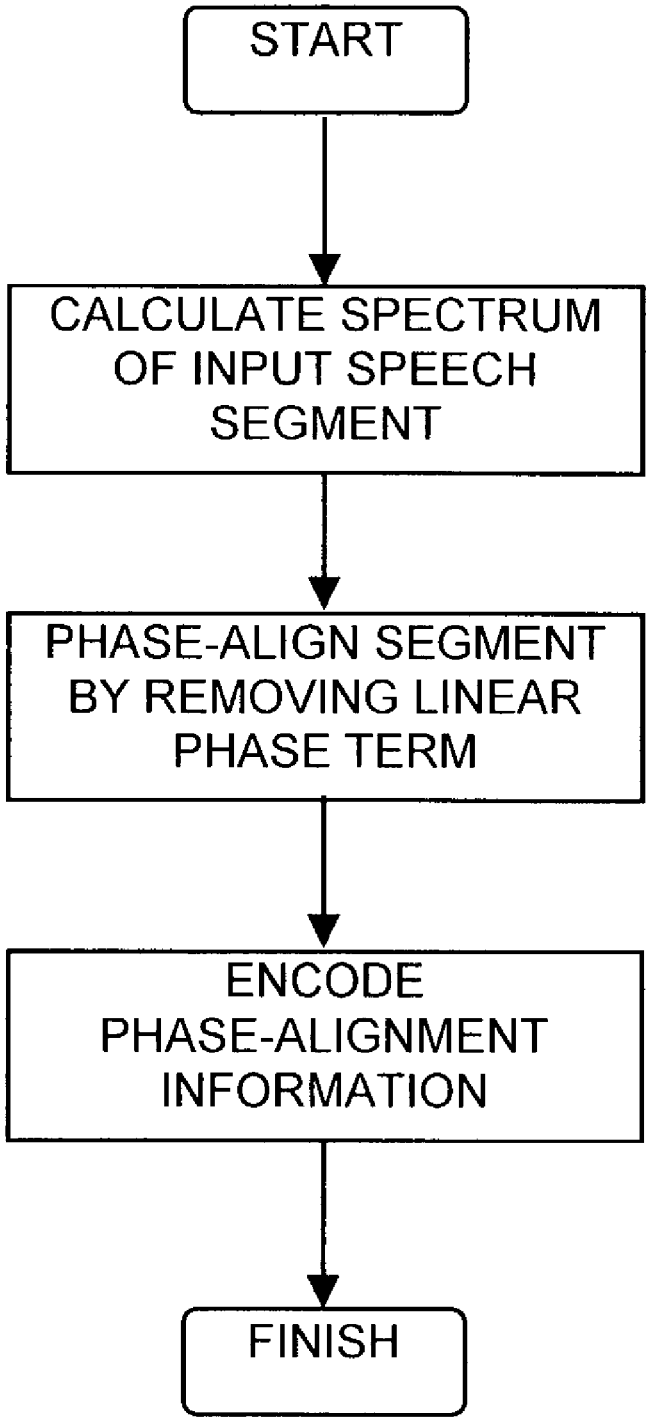
FIG. 2 is a simplified flow illustration of an exemplary method of operation of phase aligner 106 of the speech encoder of FIG. 1, operative in accordance with a preferred embodiment of the present invention.

Reference is now made to FIG. 2, which is a simplified flow illustration of an exemplary method of operation of phase aligner 106 of the speech encoder of FIG. 1, operative in accordance with a preferred embodiment of the present invention. In the method of FIG. 2 the spectrum of the input speech segment is calculated. For a voiced segment, the speech signal at time t is estimated by the amplitudes $A_k$ and the phases $\phi_k$ of each pitch harmonics $f_k$ $$x(t) \cong \sum_k A_k e^{i\varphi_k} e^{2\pi i f_k t}$$

The segment is then phase-aligned by removing a linear phase term in order to smooth the phase data and reduce phase wrapping. The aligned phase $\theta_k$ after a time offset $\tau$ is applied will be:

$$\theta_k = \phi_k - 2\pi\tau f_k$$

$\tau$ is preferably selected to make the complex spectrum as smooth as possible by minimizing the total variation of the of the spectrum divided by the square root of it's absolute value:

$$\tau = \arg\min_\tau \sum_{k=0}^{N-1} \left|\sqrt{A_{k+1}}\, e^{i\varphi_{k+1} - 2\pi\tau(f_{k+1} - f_k)} - \sqrt{A_k}\, e^{i\varphi_k}\right|^2 .$$

Since the aligned phase is smooth it is possible to estimate the complex spectrum at an arbitrary frequency by interpolation and to combine it with a phase produced by any conventional method.

In order to reduce the amount of data to be encoded, it is possible to encode only the phase of the first M pitch harmonics, where M is a parameter that controls the trade-off between quality and bandwidth. It may be user-defined or set automatically using preset values according to various parameters such as the speech bandwidth, the speaker voice, and the required quality.

The aligned phase $\theta_n$ is then encoded using quantization and/or compression by any suitable methods known in the art.

Figure 3:
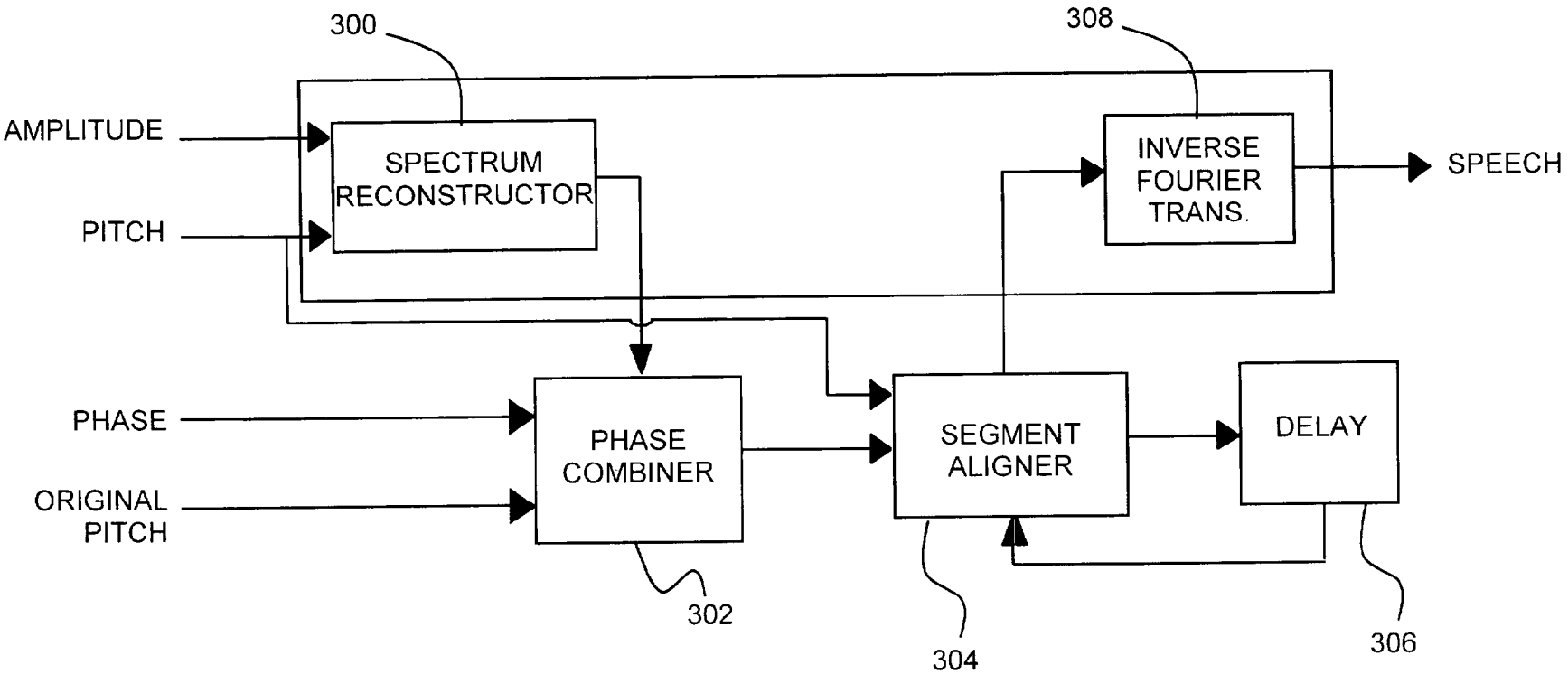
FIG. 3 is a simplified block diagram illustration of a speech decoder, constructed and operative in accordance with a preferred embodiment of the present invention.

Reference is now made to FIG. 3, which is a simplified block diagram illustration of a speech decoder, constructed and operative in accordance with a preferred embodiment of the present invention. In the speech decoder of FIG. 3, the spectrum of a speech segment is reconstructed at a spectrum reconstructor 300 using conventional means by inputting the amplitude envelope of the spectrum of the speech segment together with pitch information, which may be user-defined using known techniques, and which may or may not match the pitch of the original speech segment. The reconstructed spectrum is then input into a phase combiner 302 together with the encoded phase information and the pitch information of the original speech segment. Phase combiner 302 decodes the encoded information and reconstructs the segment's complex spectrum. The complex spectrum and the user-defined pitch information is then input into a segment aligner 304 which pitch-aligns the complex phase of the spectrum of the current speech segment to a previous speech segment that is stored in a delay 306. The phase-aligned spectrum is then input into an inverse Fourier transformator 308 which converts it into time-domain signals and concatenates it with the previous speech segment.

Figure 4:
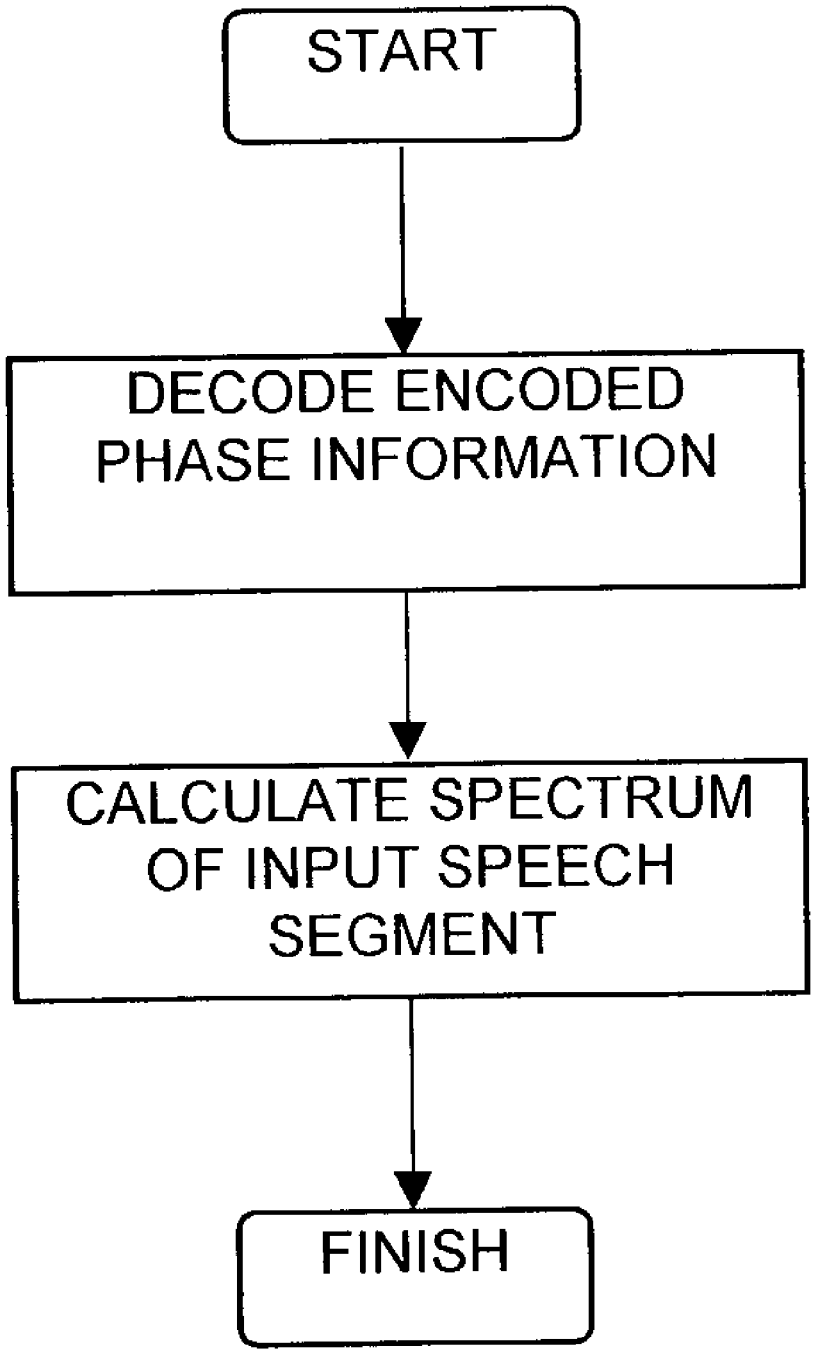
FIG. 4 is a simplified flow illustration of an exemplary method of operation of phase combiner 302 of the speech decoder of FIG. 3, operative in accordance with a preferred embodiment of the present invention.

Reference is now made to FIG. 4, which is a simplified flow illustration of exemplary method of operation of phase combiner 302 of the speech decoder of FIG. 3, operative in accordance with a preferred embodiment of the present invention. In the method of FIG. 4 the encoded phase is decoded and the values of the input speech segment's spectrum are set by:

$$F_n = \begin{cases} A'_n e^{i\theta_n} & n < M \\ A'_n e^{i\phi_n} & \text{otherwise} \end{cases}$$

where $A'_n e^{i\Phi_n}$ is the spectrum reconstructed from the encoded amplitude and pitch only, using a synthetic phase. When the pitch of the original segment differs from the pitch of the reconstructed segment, linear interpolation of the decoded phase may be used in order to estimate the phase values at the required frequencies.

Figure 5:
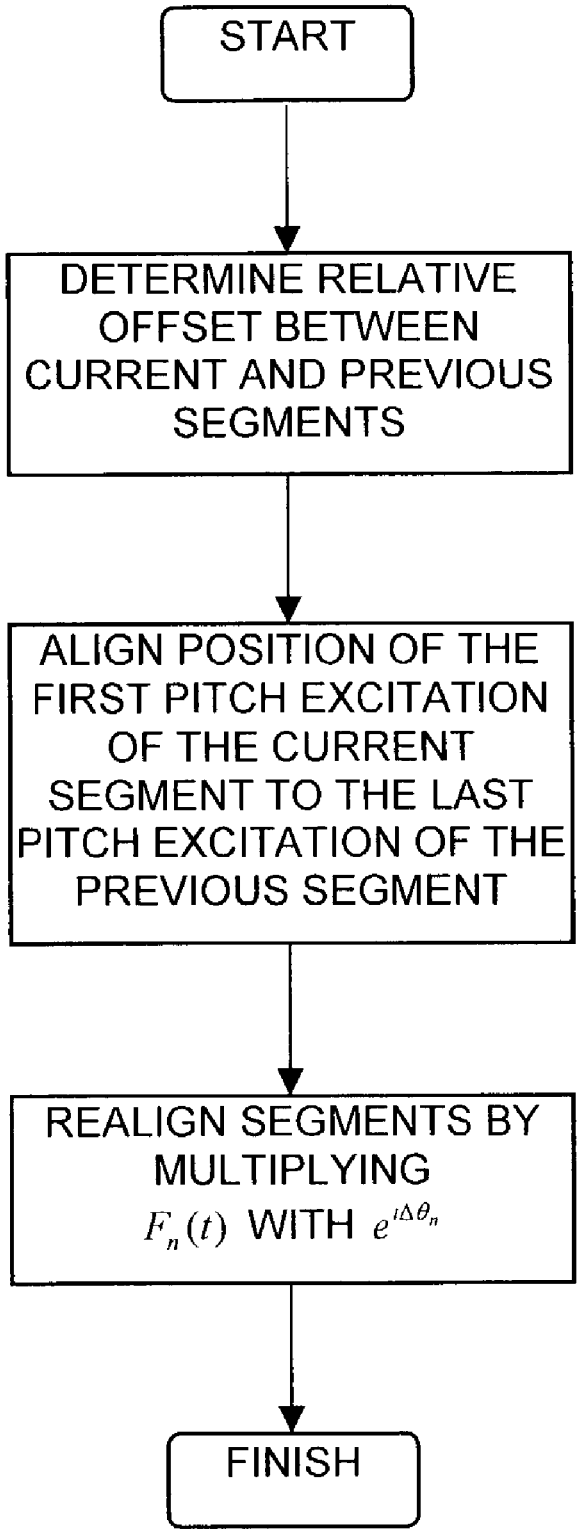
FIG. 5 is a simplified flow illustration of an exemplary method of operation of segment aligner 304 of the speech decoder of FIG. 3, operative in accordance with a preferred embodiment of the present invention.

Reference is now made to FIG. 5, which is a simplified flow illustration of an exemplary method of operation of segment aligner 304 of the speech decoder of FIG. 3, operative in accordance with a preferred embodiment of the present invention. In the method of FIG. 5, the relative offset between the current segment and the previous one is determined. The relative alignment between the segments may be found from their cross correlation function:

$$C(\tau) = \sum_{n=0}^{N} F_n \overline{G}_m e^{-2\pi i n \tau}, \; m = \left\lfloor n \frac{p_G}{p_F} + 0.5 \right\rfloor.$$

where $F_n$ and $G_m$ are the computed complex magnitude of the pitch harmonics n and m of the current and previous segments respectively, and $p_F$ and $p_G$ are the corresponding pitch periods. The correlation is preferably performed on the Hilbert transform of the segments, and thus only the positive frequencies (n, m≧0) are summed. Optimal correlation of the two Hilbert-transformed signals is preferably achieved by applying a time shift:

$$\tau_m = arg\ \max\{|C(\tau)|\}$$

and a complex phase shift $\theta_0 = -\arg(C(\tau_m))$ to the current segment.

After the two segments are relatively aligned, the position of the first pitch excitation of the current segment is aligned to the last pitch excitation of the previous segment. If in the previous segment there are $$n_p = \left\lfloor \frac{\Delta T}{p_G} + 0.5 \right\rfloor$$

pitch cycles, where ΔT is the time offset between segments, the offset in the current segment will be $$\delta = n_p p_G - \Delta T.$$

The segments are then realigned by applying a time shift and a complex Hilbert filter. This is achieved by multiplying $F_n(t)$ with $e^{i\Delta\theta_n}$, where $\Delta\theta_n$ is given by $$\Delta\theta_n = \begin{cases} \theta_0 + n\theta_1 & n \geq 0 \\ -\theta_0 + n\theta_1 & n < 0 \end{cases}$$

with $$\theta_1 = -2\pi\left(\tau_m + \frac{\delta}{p_I}\right)$$

Figure 6A:
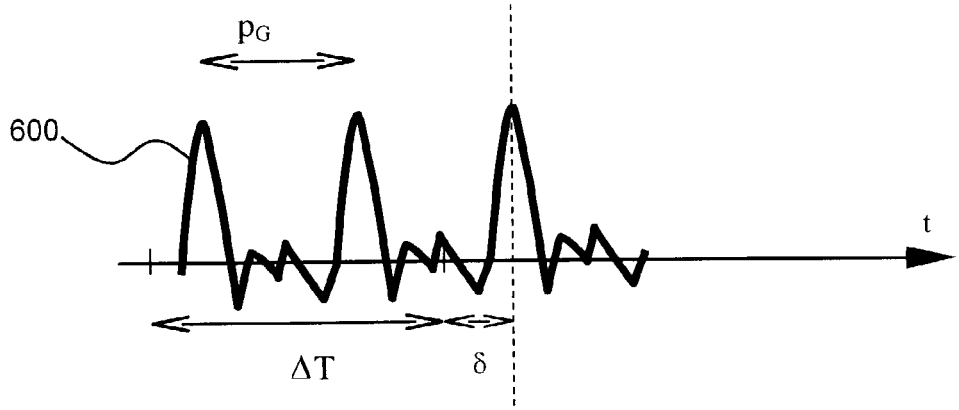
FIGS. 6A, 6B, and 6C are simplified graphical illustrations showing the phase alignment of speech segments in accordance with the application of the methods of the present invention.
Figure 6B:
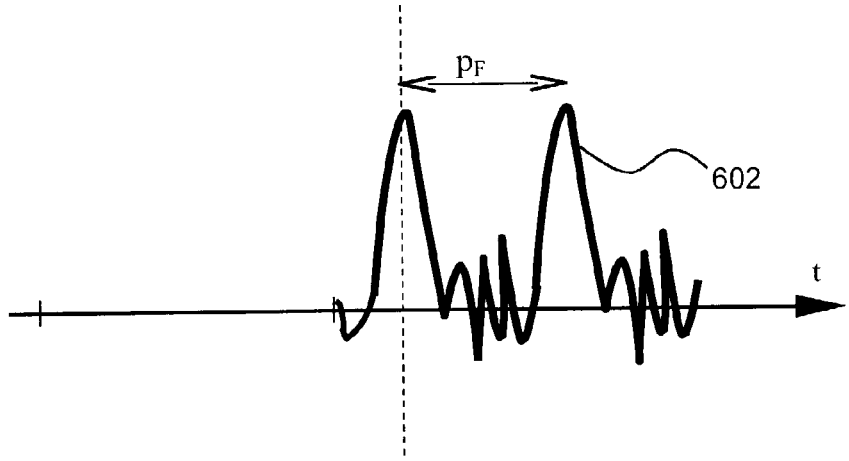
Figure 6C:
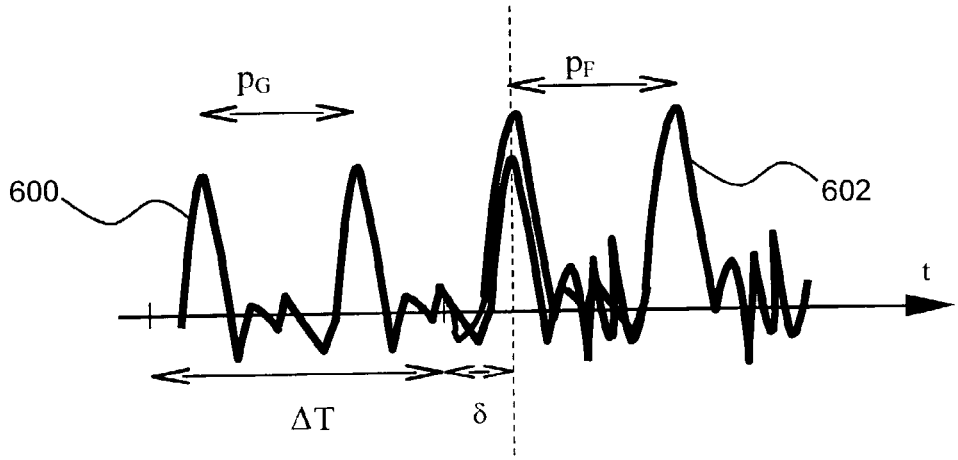

FIGS. 6A, 6B, and 6C are simplified graphical illustrations showing the phase alignment of two speech segments 600 and 602 in accordance with the application of the methods of the present invention described hereinabove.

It is appreciated that one or more of the steps of any of the methods described herein may be omitted or carried out in a different order than that shown, without departing from the true spirit and scope of the invention.

While the methods and apparatus disclosed herein may or may not have been described with reference to specific computer hardware or software, it is appreciated that the methods and apparatus described herein may be readily implemented in computer hardware or software using conventional techniques.

While the present invention has been described with reference to one or more specific embodiments, the description is intended to be illustrative of the invention as a whole and is not to be construed as limiting the invention to the embodiments shown. It is appreciated that various modifications may occur to those skilled in the art that, while not specifically shown herein, are nevertheless within the true spirit and scope of the invention.

What is claimed is:

1. A speech decoder comprising:

a spectrum reconstructor operative to reconstruct the spectrum of a speech segment from the amplitude envelope of the spectrum of said speech segment and pitch information;

a phase combiner operative to reconstruct the complex spectrum of said speech segment from said reconstructed spectrum, phase information describing said speech segment, and pitch information describing said speech segment;

a delay operative to store a complex spectrum of a previous speech segment; and a segment aligner operative to:

determine the relative offset between said complex spectrum of said speech segment and the complex spectrum of said previous speech segment;

align the position of the first pitch excitation of said current speech segment to the last pitch excitation of said previous speech segment; and apply a time shift and a complex Hilbert filter to said complex spectra, wherein said segment aligner is operative to cross-correlate said complex spectra as $$C(\tau)=\sum_{n=0}^{N} F_n\overline{G}_m e^{-2\pi i n\tau},\ m=\left\lfloor n\frac{p_G}{p_F}+0.5\right\rfloor.$$

where $F_h$, and $G_m$ are the computed complex magnitude of the pitch harmonics n and m of the current and previous spectra respectively, and $p_F$ and $p_G$ are their corresponding pitch periods.

2. A speech decoder according to claim 1, wherein said segment aligner is operative to cross-correlate on the Hilbert transform of said spectra and sum only the positive frequencies ($n,m\geqq 0$) of said spectra.

3. A speech decoder according to claim 1 wherein said segment aligner is operative to apply a time shift $\tau_m=\arg\max\{|C(\tau)|\}$ and a constant phase shift $\theta_0=-\arg(C(\tau_m))$ to said current spectrum.

4. A speech decoder according to claim 1 wherein said segment aligner is operative to determine said offset of said current complex spectrum as $\delta=n_p p_G-\Delta T$ where there are $$n_p=\left\lfloor\frac{\Delta T}{p_G}+0.5\right\rfloor$$

pitch cycles in said previous complex spectrum, and where $\Delta T$ is the time offset between said complex spectra.

5. A speech decoder according to claim 1 wherein said segment aligner is operative to apply said time shift and said complex Hilbert filter by multiplying $F_n(t)$ with $e^{i\Delta\theta_n}$, where $\Delta\theta_n$ is given by $$\Delta\theta_n=\begin{cases}\theta_0+n\theta_1 & n\geq 0\\ -\theta_0+n\theta_1 & n<0\end{cases}$$

with $$\theta_1=-2\pi\left(\tau_m+\frac{\delta}{p_F}\right).$$

6. A segment aligner comprising:

means for determining the relative offset between a complex spectrum of a speech segment and a complex spectrum of a previous speech segment;

means for aligning the position of the first pitch excitation of said current speech segment to the last pitch excitation of said previous speech segment; and means for applying a time shift and a complex Hilbert filter to said complex spectra, wherein said means for determining is operative to cross-correlate said complex spectra as $$C(\tau)=\sum_{n=0}^{N} F_n\overline{G}_m e^{-2\pi i n\tau},\ m=\left\lfloor n\frac{p_G}{p_F}+0.5\right\rfloor,$$

where $F_n$ and $G_m$ are the computed complex magnitude of the pitch harmonics n and m of the current and previous spectra respectively, and $p_F$ and $p_G$ are their corresponding pitch periods.

7. A segment aligner according to claim 6 wherein said means for determining is operative to cross-correlate on the Hubert transform of said spectra and sum only the positive frequencies ($n,m\geqq 0$) of said spectra.

8. A segment aligner according to claim 6 wherein said means for aligning is operative to apply a time $\tau_m=\arg\max\{|C(\tau)|\}$ and a constant phase shift $\theta_0=-\arg(C(\tau_m))$ to said current spectrum.

9. A segment aligner according to claim 6 wherein said means for determining is operative to determine said offset of said current complex spectrum as $\delta=n_p p_G-\Delta T$ where there are $$n_p=\left\lfloor\frac{\Delta T}{p_G}+0.5\right\rfloor$$

pitch cycles in said previous complex spectrum, and where $\Delta T$ is the time offset between said complex spectra.

10. A segment aligner according to claim 6 wherein said means for aligning is operative to apply said time shift and said complex Hilbert filter by multiplying $F_n(t)$ with $e^{i\Delta\theta_n}$, where $\Delta\theta_n$ is given by $$\Delta\theta_n=\begin{cases}\theta_0+n\theta_1 & n\geq 0\\ -\theta_0+n\theta_1 & n<0\end{cases}$$

with $$\theta_1=-2\pi\left(\tau_m+\frac{\delta}{p_F}\right).$$

* * * * *